US005564914A

United States Patent [19]

Kobayashi et al.

[11] Patent Number: 5,564,914

[45] Date of Patent: Oct. 15, 1996

[54] FLUID MACHINE WITH INDUCTION MOTOR

[75] Inventors: Makoto Kobayashi; Masakazu Yamamoto; Yoshio Miyake, all of Fujisawa, Japan

[73] Assignee: Ebara Corporation, Tokyo, Japan

[21] Appl. No.: 322,341

[22] Filed: Oct. 13, 1994

[30] Foreign Application Priority Data

Oct. 13, 1993 [JP] Japan ..... 5-280110

[51] Int. Cl.[6] ..... F04B 35/04

[52] U.S. Cl. ..... 417/423.7; 417/326; 417/423.5; 415/912

[58] Field of Search ..... 417/53, 326, 423.7, 417/423.5, 4238; 415/912

[56] References Cited

U.S. PATENT DOCUMENTS

| | | | |
|---|---|---|---|
| 2,824,520 | 2/1958 | Bartels | 417/423.7 |
| 3,841,791 | 10/1974 | Doolin | 415/912 |
| 4,511,312 | 4/1985 | Hartwig | 417/423.7 |
| 4,990,068 | 2/1991 | Zhong et al. | 417/423.8 |
| 5,126,642 | 6/1992 | Shahrodi . | |
| 5,364,239 | 11/1994 | Ishikura | 417/423.7 |

FOREIGN PATENT DOCUMENTS

| | | |
|---|---|---|
| 0100390 | 2/1984 | European Pat. Off. . |
| 2007770 | 5/1979 | United Kingdom . |
| 2021693 | 12/1979 | United Kingdom . |

OTHER PUBLICATIONS

"Worthington D-1000 new standard end-suction pumps" 1973, Worthington Standard Pump Co.

Patent Abstracts of Japan, vol. 14, No. 223, (P-1046), Nov. 5, 1990, JP-A-2-052223, Feb. 2, 1990.

World Pumps, No. 12, pp. 361-366, Dec. 1985, "Effects Of VSC On ESP Performance".

*Primary Examiner*—Charles Freay

*Attorney, Agent, or Firm*—Oblon, Spivak, McClelland, Maier & Neustadt, P.C.

[57] ABSTRACT

A fluid machine system has such characteristics that the flow rate is proportional to the rotational speed, the produced pressure is proportional to the square of the rotational speed, and the shaft power is proportional to the cube of the rotational speed. The fluid machine system has a first fluid machine actuatable by an induction motor, and a second fluid machine actuatable by the induction motor for producing a flow rate of 1/K and a shaft power of 1/K of those the first fluid machine at the same rotational speed as that of the first fluid machine for generating the same pressure as that of the first fluid machine. The fluid machines having many times of design points can be operated by the same induction motor.

7 Claims, 4 Drawing Sheets

FLUID MACHINE WITH INDUCTION MOTOR

BACKGROUND OF THE INVENTION

1. Field of the Invention:

The present invention relates to a fluid machine with an induction motor, and more particularly to a fluid machine having many types of design points which can be operated by the same induction motor.

2. Description of the Prior Art:

Heretofore, a voltage and a frequency to be supplied to a motor are uniquely determined at a site where the motor is used. In order to enable the motor to be common use, it has been customary to provide a design point where shaft powers (motor outputs) are the same and to vary a flow rate and a produced pressure.

FIG. 4 of the accompanying drawings shows the relationship between a flow rate (Q) and a head (H) of a conventional fluid machine with an induction motor. A pump, for example, will be described as a non-positive displacement fluid machine having such characteristics that the flow rate is proportional to the rotational speed, the produced pressure is proportional to the square of the rotational speed, and the shaft power is proportional to the cube of the rotational speed.

A motor $\alpha$ is combined with a pump A at a flow rate Q and a head H, a motor $\beta$ is combined with a pump B at a flow rate (1/K)Q and the head H, and the motor $\alpha$ is combined with a pump C at the flow rate (1/K)Q and the head KH, thereby handling three particular points. Thus, three particular points are handled by two types of motors and three types of pumps.

Various specifications at the particular points are shown in FIG. 4.

With the conventional fluid machine arrangement, however, it is necessary to have a fluid machine available at each of the particular points, as shown in FIG. 4, and a motor can be shared only at the same output point. As a result, the number of types of design points of a fluid machine is enormous as compared with the number of types of motors used.

SUMMARY OF THE INVENTION

It is therefore an object of the present invention to provide a fluid machine with an induction motor which can be shared at the same torque point by using a frequency/voltage converter, and which can satisfy many particulars with few fluid machines.

According to the present invention, there is provided a fluid machine system having such characteristics that the flow rate is proportional to the rotational speed, the produced pressure is proportional to the square of the rotational speed, comprising a first induction motor operable at at least two frequencies and rotational speeds; a first fluid machine mountable to an output shaft of said first induction motor for actuation by said first induction motor at a first of said rotational speeds, said first fluid machine producing a flow rate Q and a shaft power P and a pressure H at said first of said rotational speeds when said first induction motor operates at a first of said frequencies; and a second fluid machine mountable to an output shaft of another induction motor and operable at a design point specifying a flow rate of 1/K times Q and a shaft power of 1/K times P and the pressure H when said second fluid machine is actuated by said another induction motor at said first of said rotational speeds. The second fluid machine is also operable at a design point specifying a flow rate which is $K^{-1/2}$ times Q, a pressure which is K times H, a shaft power which is $K^{1/2}$ times P, and a torque which is equal to that of said first fluid machine when said second fluid machine is actuated by said first induction motor, operating at a second of said frequencies which is $K^{1/2}$ times that of said first of said frequencies, at a second of said rotational speeds which is $K^{1/2}$ times that of said first of said rotational speeds. Fluid machines operable at different design points can therefore be operated by a given induction motor.

With this arrangement, a wide range of particulars can be handled with a combination of few types of fluid machines and motors, and design points can be placed in a narrow range of specific speeds for high efficiency and productivity.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
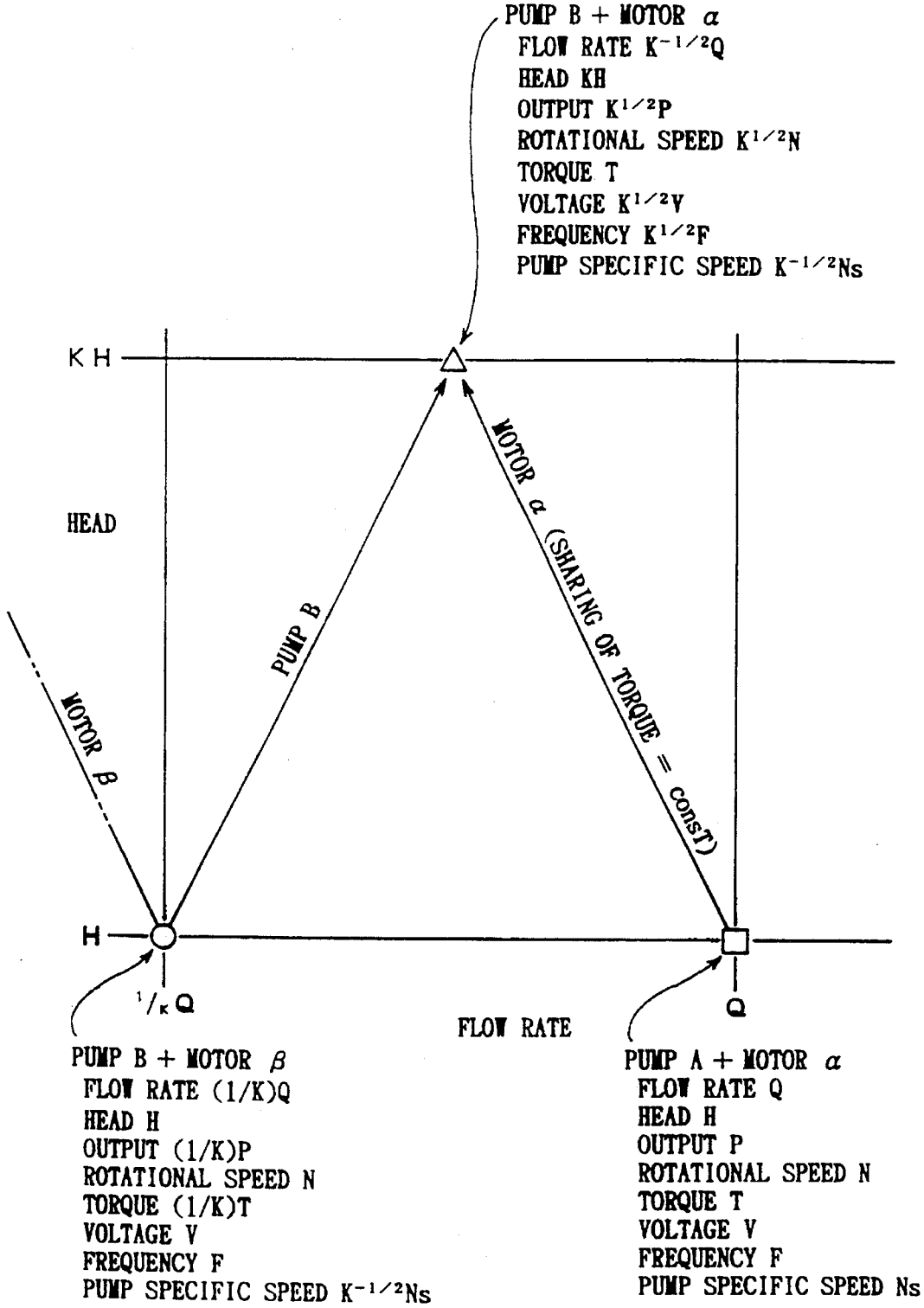
FIG. 1 is a diagram illustrative of a fluid machine with an induction motor according to the present invention.

FIG. 1 shows a basic arrangement of a fluid machine with an induction motor according to the present invention. In FIG. 1, a pump, for example, is illustrated as a non-positive displacement fluid machine having such characteristics that the flow rate is proportional to the rotational speed, the produced pressure is proportional to the square of the rotational speed, and the shaft power is proportional to the cube of the rotational speed.

A pump A having a rotational speed N, a pump head H, a flow rate Q and a shaft power P is actuated by a motor $\alpha$ at a frequency F and a voltage V. Another pump B having a rotational speed N, a pump head H, a flow rate (1/K)Q and a shaft power (1/K)P is actuated by a motor $\beta$ at a frequency F and a voltage V, where K is a constant flow rate or head nominal value. Various specifications of the pumps A, B and the motors $\alpha$, $\beta$ are shown in FIG. 1.

If the pump B is coupled to the motor $\alpha$, then the pump B is operated for a flow rate $K^{-1/2}Q$, a pump head KH, a shaft power $K^{1/2}P$, a rotational speed $K^{1/2}N$, and a torque T by the motor $\alpha$ at a frequency $K^{1/2}F$ and a voltage $K^{1/2}V$. The frequency and voltage of the motor $\alpha$ can be varied by a frequency/voltage converter.

The pump B can be shared at particular points marked by 0, $\Delta$ in FIG. 1 because the rotational speed can be increased by the frequency/voltage converter. Specifically, since the rotational speed at the particular point $\Delta$ is $K^{1/2}$ times the rotational speed at the particular point 0, the flow rate becomes $K^{-1/2}Q$, the pump head becomes KH, and the shaft power becomes $K^{1/2}P$. K is preferably 1.6 or a similar value.

The motor α shifts from a particular point marked by □ to the particular point Δ because when the frequency increases while the ratio F/V of the voltage and the frequency is being constant, the rotational speed increases in proportion to the frequency while the torque T is being constant, and hence the output also increases in proportion to the rotational speed.

According to the present invention, therefore, the three particular points can be realized by two types of motors and two types of pumps.

In order to satisfy the particular point Δ at the same rotational speed N as that of the particular points 0, □, not only a new motor is necessary, but also a pump having a specific speed $K^{-1}Ns$ is needed. That is, there is required a pump having a smaller specific speed than the pump B (specific speed $K^{-1/2}Ns$) which is operated at the rotational speed $K^{1/2}N$. This indicates that the present invention can cope with a wider range of particulars with a smaller range of pump specific speeds.

Therefore, a wide range of particulars can be handled by using only pumps having specific speeds which are advantageous from the standpoints of pump performance and pump productivity, i.e., pumps having pressed impellers.

Figure 2:
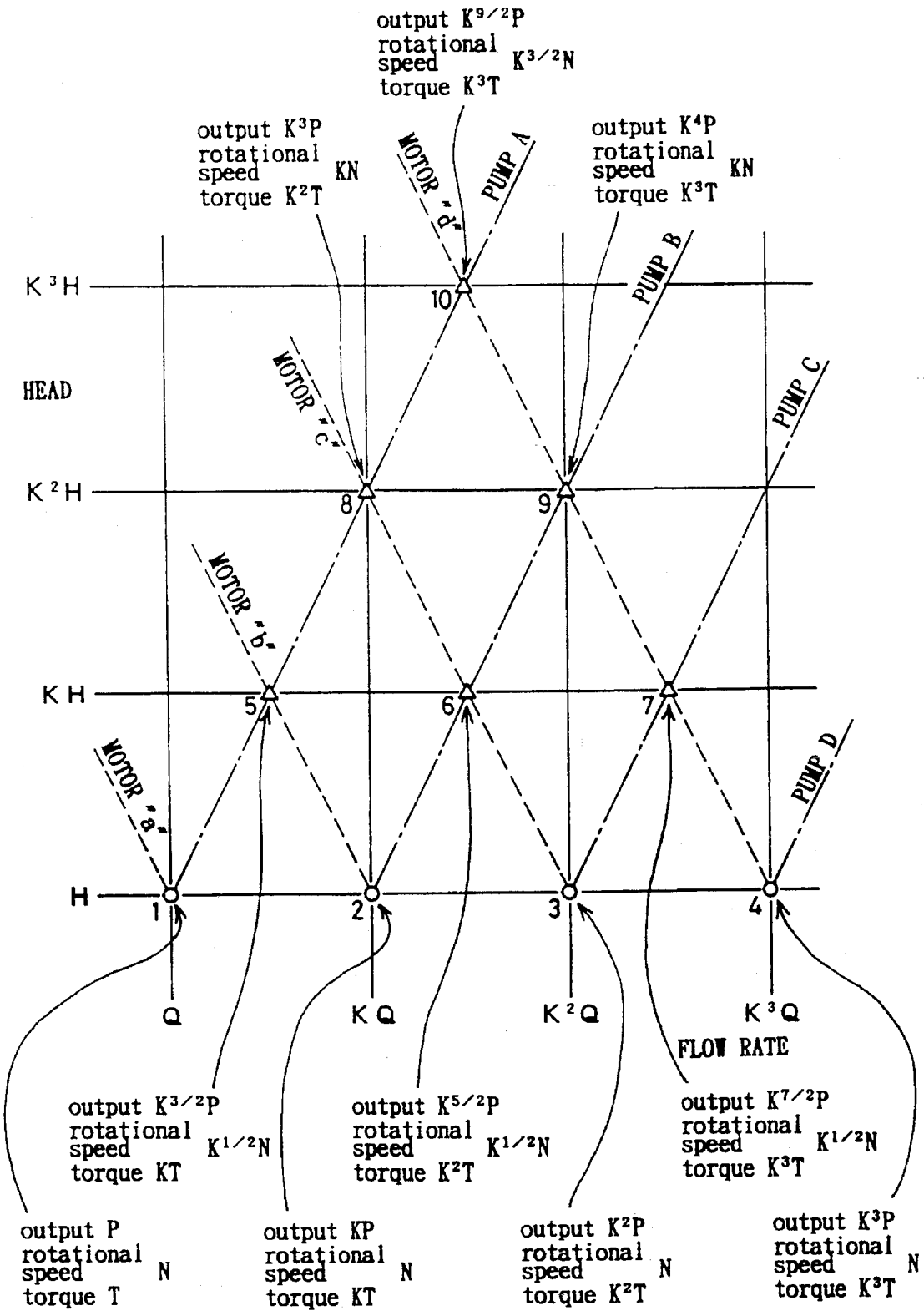
FIG. 2 is a diagram illustrative of the fluid machine with an induction motor according to the present invention.

FIG. 2 shows the arrangement shown in FIG. 1 at an enlarged scale. In FIG. 2, four pump types A, B, C, D and four motor types "a", "b", "c", "d" are made available.

Since there are ten points of intersection in FIG. 2, ten particular points can be realized with four pump types and four motor types. Consequently, many particular points can be satisfied with few fluid machines and few motors.

Figure 3:
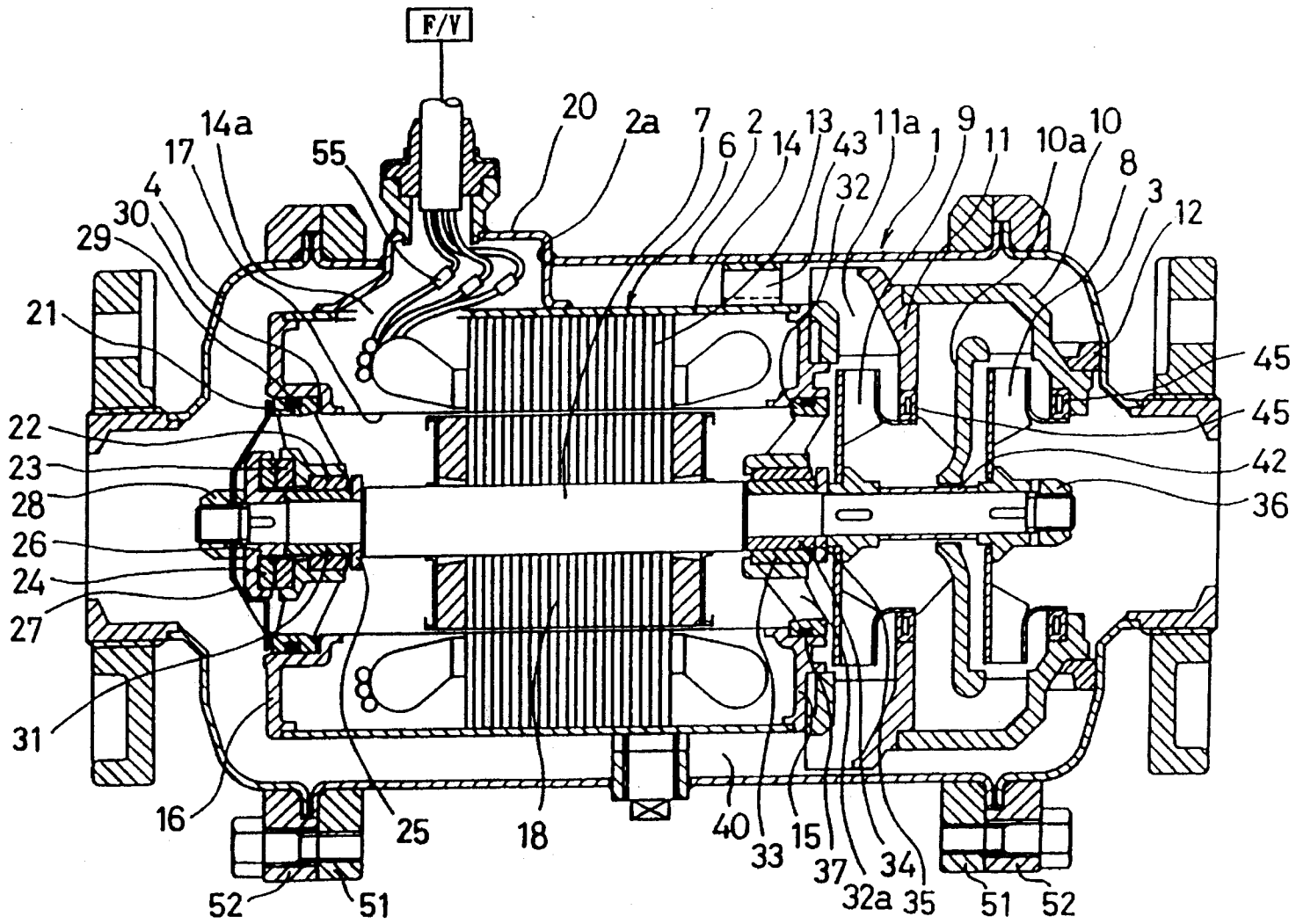
FIG. 3 is a cross-sectional view of a pump which may preferably be employed as the fluid machine with an induction motor according to the present invention.
Figure 4:
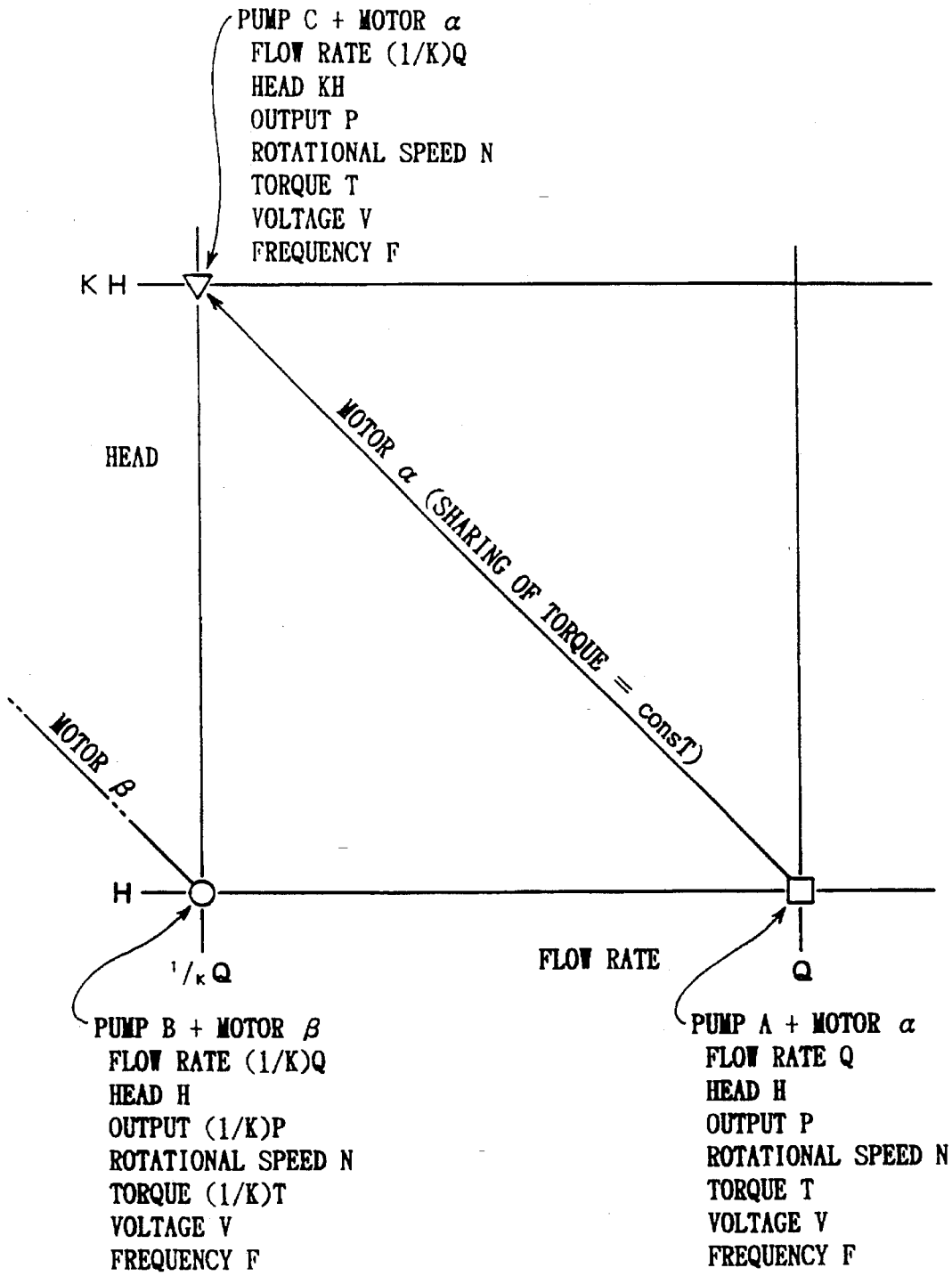
FIG. 4 PRIOR ART
FIG. 4 is a diagram illustrative of a conventional fluid machine with an induction motor.

A pump which may preferably be employed as the fluid machine with an induction motor according to the present invention will be described below with reference to FIG. 3. FIG. 3 shows in cross section a full-circumferential-flow pump which comprises a pump casing 1, a canned motor 6 housed in the pump casing 1, and a pair of impellers 8, 9 fixedly mounted on a main shaft 7 of the canned motor 6. The pump casing 1 comprises an outer casing member 2, a suction casing member 3 connected to an axial end of the outer casing member 2 by flanges 51, 52, and a discharge casing member 4 connected to an opposite axial end of the outer casing member 2 by flanges 51, 52. Each of the outer casing member 2, the suction casing member 3, and the discharge casing member 4 is made of a pressed sheet of stainless steel or the like.

The impeller 8 is housed in a first inner casing 10 having a return vane 10*a*, the first inner casing 10 being disposed in the pump casing 1. The impeller 9 is housed in a second inner casing 11 having a guide device 11*a*, the second inner casing 11 disposed in the pump casing 1 and connected to the first inner casing 10. A resilient seal 12 is interposed between the first inner casing 10 and the suction casing member 3. Liner rings 45 are mounted on radially inner ends, respectively, of the first and second inner casings 10, 11.

The canned motor 6 comprises a stator 13, an outer motor frame barrel 14 fixedly fitted over the stator 13 and securely disposed in the pump casing 1, a pair of motor frame side plates 15, 16 welded to respective opposite open ends of the outer motor frame barrel 14, and a can 17 fitted in the stator 13 and welded to the motor frame side plates 15, 16. The canned motor 6 also has a rotor 18 rotatably disposed in the stator 13 and hence the can 17, and shrink-fitted over the main shaft 7.

A cable housing 20 is welded to the outer motor frame barrel 14. Leads from coils disposed in the outer motor frame barrel 14 are extended and connected to a power supply cable in the cable housing 20, which is in turn connected to a frequency/voltage converter.

The pump has an anti-thrust load bearing assembly and a thrust load bearing assembly.

First, the anti-thrust load bearing assembly will be described below. A radial bearing 22 and a fixed thrust bearing 23 are mounted on a bearing bracket 21 near the discharge casing member 4. The radial bearing 22 has an end which serves as a fixed thrust sliding member. A rotary thrust bearing 24 serving as a rotary thrust sliding member and a thrust collar 25 are disposed one on each side of the radial bearing 22 and the fixed thrust bearing 23. The rotary thrust bearing 24 is secured to a thrust disk 26 which is fixed to the main shaft 7 through a sand shield 27 by a nut 28 threaded over an externally threaded surface on an end of the main shaft 7.

The bearing bracket 21 is inserted in a socket defined in the motor frame side plate 16 through a resilient O-ring 29. The bearing bracket 21 is also held against the motor frame side plate 16 through a resilient gasket 30. The radial bearing 22 is slidably supported on a sleeve 31 which is fitted over the main shaft 7.

The thrust load bearing assembly will now be described below. A radial bearing 33 is mounted on a bearing bracket 32 near the impeller 9, and slidably supported on a sleeve 34 which is fitted over the main shaft 7. The sleeve 34 is axially held against a washer 35 which is fixed the main shaft 7 through the impeller 9, a sleeve 42, and the impeller 8 by a nut 36 threaded over an externally threaded surface on an opposite end of the main shaft 7. The bearing bracket 32 is inserted in a socket defined in the motor frame side plate 15 through a resilient O-ring 37. The bearing bracket 32 is also held against the motor frame side plate 15.

Operation of the full-circumferential-flow pump shown in FIG. 2 will be described below. A fluid drawn into the suction casing 3 is pressurized by the impellers 8, 9, and oriented from a radial direction into an axial direction by the guide device 11a. Therefore, the fluid flows into an annular passage 40 defined between the outer casing member 2 and the outer motor frame barrel 14, and then flows through the annular passage 40 into the discharge casing member 4.

From the discharge casing member 4, most of the fluid is discharged through a discharge port out of the pump. The remaining fluid passes behind the sand shield 27 into a rotor chamber in which it lubricates the bearings 22, 23, 24, 35. Thereafter, the fluid flows through an opening 32*a* defined in the bearing bracket 32, and Joins the fluid which is discharged from the impeller 9.

Generally, for a constant-torque load, i.e., for a load having a constant torque even when the rotational speed varies, the rotational speed can be controlled by varying the frequency while keeping the voltage/frequency ratio constant. It is known that the motor flux is constant at this time, and the current and the heat generated by the motor remain the same.

One problem with the above control process is that even though the heat generated by the motor remains the same, the temperature of stator windings does not remain the same. For example, a motor with a motor cooling fan mounted on a shaft end thereof cannot be operated at too low a rotational speed because the cooling capability is lowered as the rotational speed decreases. If a motor structure is such that the heat produced by bearings affects the temperature of the stator windings, the temperature of the stator windings may be too high when the rotational speed increases.

According to the present invention, as shown in FIG. 3, the motor is of a forced-cooling structure and is of the canned type. By passing a solution pumped by the pump into a rotor chamber, the heat produced by the rotor and the heat produced by the bearings are prevented from affecting the temperature of the stator windings.

With the arrangement of the present invention, a wide range of particulars can be handled with a combination of few types of fluid machines and motors, and design points can be placed in a narrow range of specific speeds for high efficiency and productivity.

Furthermore, a high pressure and output can be produced by a fluid machine by employing a frequency/voltage converter without changing outer configuration and dimensions of the fluid machine. Since the torque is the same even if the rotational speed is different, the main shaft and key structures may be shared.

Although a certain preferred embodiment of the present invention has been shown and described in detail, it should be understood that various changes and modifications may be made therein without departing from the scope of the appended claims.

What is claimed is:

1. A fluid machine system having such characteristics that the flow rate is proportional to the rotational speed, the produced pressure is proportional to the square of the rotational speed, and the shaft power is proportional to the cube of the rotational speed, comprising:

a first induction motor operable at at least two frequencies and rotational speeds;

a first fluid machine mountable to an output shaft of said first induction motor for actuation by said first induction motor at a first of said rotational speeds, said first fluid machine producing a flow rate Q and a shaft power P and a pressure H at said first of said rotational speeds when said first induction motor operates at a first of said frequencies; and a second fluid machine mountable to an output shaft of another induction motor and operable at a design point specifying a flow rate of 1/K times Q and a shaft power of 1/K times P and the pressure H when said second fluid machine is actuated by said another induction motor at said first of said rotational speeds;

said second fluid machine also operable at a decision point specifying a flow rate which is $K^{-1/2}$ times Q, a pressure which is K times H, a shaft power which is $K^{1/2}$ times P, and a torque which is equal to that of said first fluid machine When said second fluid machine is actuated by said first induction motor, operating at a second of said frequencies which is $K^{-1/2}$ times that of said first of said frequencies, at a second of said rotational speeds which is $K^{1/2}$ times that of said first of said rotational speeds, whereby fluid machines operable at different design points can be operated by a given induction motor.

2. The fluid machine system according to claim 1, further comprising a frequency/voltage converter connected to each of said fluid machines for varying the frequency and the voltage simultaneously stepwise at a nominal ratio of $K^{1/2}$.

3. The fluid machine system according to claim 1, wherein said induction motor comprises a canned motor so as to be cooled by a liquid.

4. The fluid machine system according to claim 1 or 2, wherein each of said first and second fluid machines comprises a pump.

5. The fluid machine system according to claim 4, wherein said pump comprises a full-circumferential-flow pump having an annular fluid passage around said induction motor, and said induction motor is arranged so as to be cooled by a liquid in said annular fluid passage.

6. The fluid machine system according to claim 4, wherein said induction motor is of the self-lubricated type and has a rotor, bearings and stator windings, and said induction motor is arranged so as to prevent the heat generated by said rotor and said bearings from substantially rising the temperature of said stator windings.

7. The fluid machine system according to claim 1 wherein K is 1.6 or a similar value.

* * * * *

UNITED STATES PATENT AND TRADEMARK OFFICE

CERTIFICATE OF CORRECTION

PATENT NO. : 5,564,914

DATED : OCTOBER 15, 1996

INVENTOR(S) : MAKOTO KOBAYASHI ET AL

It is certified that error appears in the above-indentified patent and that said Letters Patent is hereby corrected as shown below:

Column 6, line 4, change "decision" to --design--

Column 6, line 8, change "When" to --when--

Column 6, line 10, change "$K^{-}_{1/2}$" to --$K^{1/2}$--

Signed and Sealed this

Twenty-ninth Day of July, 1997

Bruce Lehman

*Attest:*

BRUCE LEHMAN

*Attesting Officer*

*Commissioner of Patents and Trademarks*